United States Patent [19]

Saul

[11] 4,023,684

[45] May 17, 1977

[54] CANTILEVER RACK STRUCTURE

[75] Inventor: David M. Saul, Pittsburgh, Pa.

[73] Assignee: Rack Engineering Company, Connellsville, Pa.

[22] Filed: Sept. 8, 1975

[21] Appl. No.: 611,562

[52] U.S. Cl. ..... 211/193; 52/721; 248/243

[51] Int. Cl.[2] ..... A47B 43/00; A47F 5/01

[58] Field of Search ..... 52/721, 729, 751, 758 R; 211/176, 177, 60, 148, 134, 153, 190–193; 248/223, 243, 244, 245, 235; 403/187, 189, 232, 262; 108/108–110

[56] References Cited

UNITED STATES PATENTS

| | | | |
|---|---|---|---|
| 2,937,766 | 5/1960 | Penn | 211/176 |
| 3,251,478 | 5/1966 | Frazier | 211/176 |
| 3,295,288 | 1/1967 | Bakke et al. | 52/721 X |
| 3,358,848 | 12/1967 | Johnsson | 211/177 |
| 3,554,477 | 1/1971 | D'Altrui | 211/176 X |
| 3,716,959 | 2/1973 | Bernardi | 52/721 |
| 3,854,686 | 12/1974 | Konstant | 248/243 |

*Primary Examiner*—Roy D. Frazier

*Assistant Examiner*—Terrell P. Lewis

*Attorney, Agent, or Firm*—Parmelee, Miller, Welsh & Kratz

[57] ABSTRACT

A cantilever rack structure has at least two wide flange I-beams comprising upright standards connected to each other and with stabilizing base members at their lower ends, the flanges of these standards facing forwardly and rearwardly and with the web between the flanges extending from front to back. One or both flanges of the I-beams has a vertical row of holes therethrough at each side of the web, the rows of holes being close to but spaced laterally from the web. Load-supporting arm members comprise a plate adapted to fit against the flange of an I-beam and a forwardly-projecting rigid arm extending from the plate, each plate having at least two laterally-spaced holes therethrough so that one hole registers with a selected hole in each of the two vertical rows of holes through the I-beam flange, and bolts with removable nuts secure the arms to the uprights. Connecting brace members extend from the front flange at one end to the rear flange at the other.

3 Claims, 8 Drawing Figures

CANTILEVER RACK STRUCTURE

This invention is for an improvement in industrial storage racks of the type known as cantilever storage racks. In general cantilever storage racks comprise parallel upright columns sometimes placed against an interior wall of a building and sometimes they are free-standing. Load-supporting arms are secured at one end only to these columns and project horizontally outward from the columns, or generally horizontally, but with slight rake, sloping downwardly toward the inner ends of the arms. Projecting in this manner from the columns the arms are said to be cantilevered. The arms of at least two spaced columns are positioned at the same level on their respective columns, so that long bars or rods or pipe or tubing or the like may be rested on two or more such arms, spanning without intervening support the distance from one column to the next. This is clearly shown and described, for example, in U.S. Pat. No. 3,795,183 dated Feb. 26, 1974 issued to Rack Engineering Company, which is also my assignee of this invention.

A rack of this type usually has a series of cantilever arms on each column so that several products can be stored on the rack at vertically separated levels. The arms are usually adjustable on the columns so that the spacing vertically between the arms can be selected according to the amount or bulk of material to be stored at each level. One rack structure also may have a greater number of arms more closely spaced than those of another rack structure. While storage of bars, rods pipe and the like has been mentioned, other products may be stored thereon and in some cases shelves may be placed on some of the arms for the support of other types of articles or supplies.

Free-standing racks spaced from the building walls may often have cantilever arms extending in opposite directions from the columns.

The present invention provides a cantilever rack of simple construction with arms that can be readily adjusted on the uprights. Standard wide flange structural I-beam sections provide the upright columns or standards for the structure. The wide flanges at the front face of each column have flange portions extending to each side of the web of the I-beam at right angles to the web, and each such flange portion has a vertical row of holes therethrough normal to the face of the flange so that there is a row of holes through the front flange at each side of the web of each column and for free-standing racks where the arms may extend in opposite directions from the column, such holes are provided in both the front and rear flanges of the column. The arms are also of a standard structural section, usually, but not necessarily, a wide flange I-beam with one end butted against a metal plate and welded thereto. The plate has holes therethrough, at least two, but usually four, all of which register with selected holes in the rows of holes in the column, two over selected holes in the row of holes in the flange at the right side of the web of the I-beam and the other two will then register with holes in the row of holes in the flange at the left side of the web. Bolts pass through the plate and a flange in each of two positions where the holes register, with a nut screwed onto the end of each bolt. Usually the two bolts will pass through the pair of holes near the top of the plate, that is, the uppermost pair of holes. The term "bolts" is intended to include threaded studs fixed to the plate and projecting from the rear face thereof.

It will be seen that with this arrangement the arms are centered in the plane of the web of the I-beam column and the load on each arm is transmitted to the column in the direction in which the column has maximum resistance to bending, so that the arms, even on relatively high racks, can be safely loaded. As above stated, arms may extend from opposite faces of the columns, and if desired, the arms may be constructed to telescope for adjusting their length where such adjustment is found desirable. I am aware that columns of I-beam structural shape have heretofore been proposed but these, however, lacked both the strength and convenience of the present invention. In U.S. Pat. No. 3,212,648, the load-supporting arms are at right angles to the web of the I-beam columns and the arms are carried on the two flanges of the vertical column. In U.S. PAT. No. 3,251,478 the supporting arms are of yokelike form embracing the front flange of an I-beam column but the arms are slidable vertically on cleats bolted to the web of the I-beam in such manner that if they should be bumped upwardly by a crane lifting a bundle of rods, for example, the arms may be knocked loose or completely removed.

The invention may be more fully understood by reference to the accompanying drawings showing a present preferred embodiment of the invention, and in which.

Figure 1:
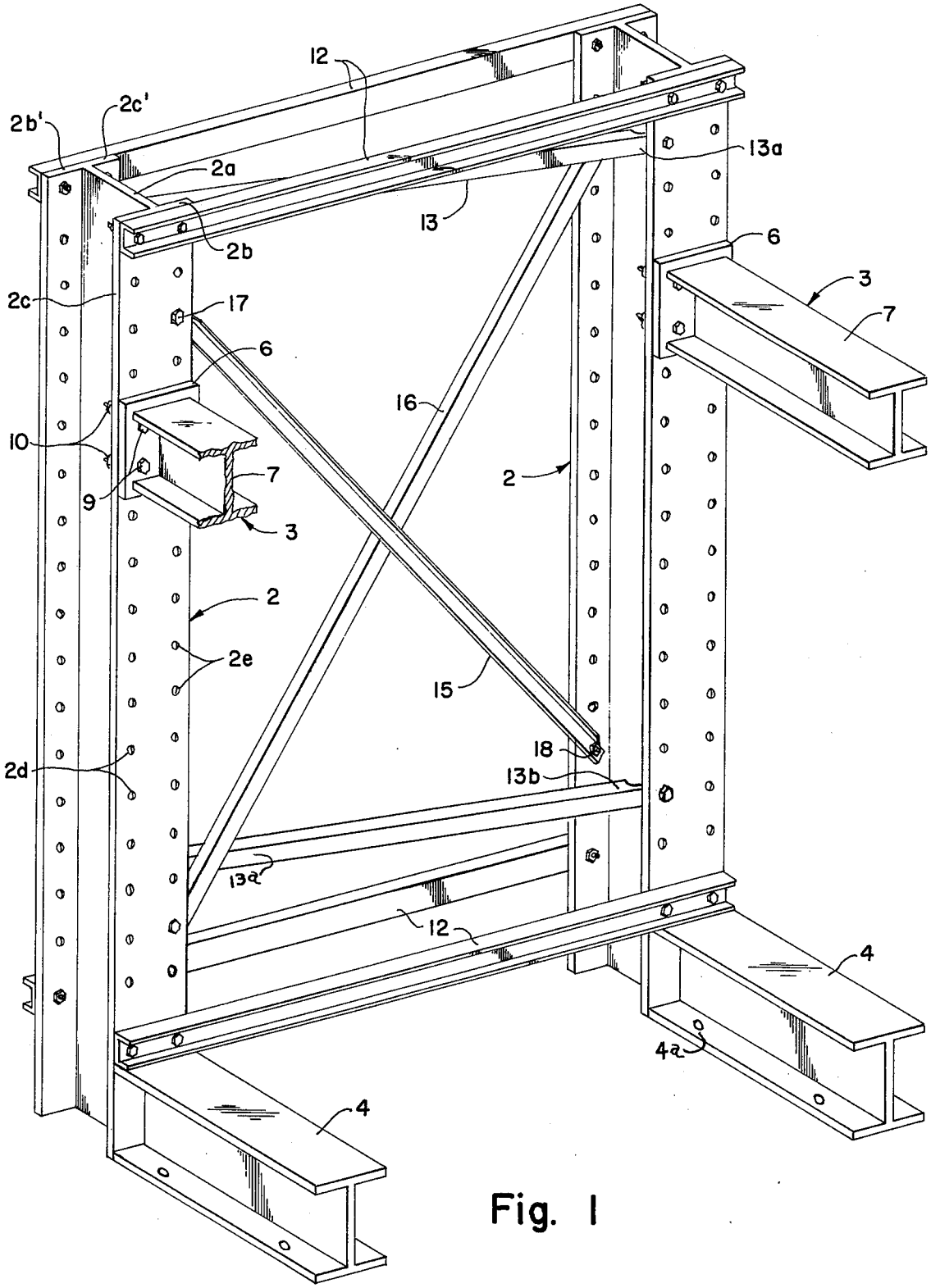
FIG. 1 is a somewhat schematic perspective view of a simple two-column rack embodying my invention.

A cantilever rack comprises at least two columns as indicated generally at 2 in FIG. 1, both being alike. Each column has one or more, generally several, vertically-spaced arms 3 extending in a generally horizontal direction forwardly from each column, the arms on both columns being at the same level so that a bundle of steel bars, for example, placed on the corresponding arms of the two columns, will be safely supported thereon, the distance between the columns in each case being less than the length of the bars in the bundle. In some cases a shelf may be supported on the arms and shorter objects or products placed on the shelf. The manner of arranging and using cantilever racks is well known and they are widely used industrially. The term "cantilever racks" is, of course, derived from the fact that the arms are attached at only one end to a supporting column, the arms being cantilevered on the vertical columns.

With the present invention each column 2 is a standard wide flange I-beam section extending vertically from a short, generally similar horizontal base section 4. Each column 2 has a central web 2*a* between two similar wide flanges, each flange having a portion 2*b* and 2*c* respectively at the front and back extending to the left of the web and a portion 2*b'* and 2*c'*, respectively, extending to the right of the web. The base sections 4 extend forward from the front face of the respective columns.

The front flange portions 2*b* and 2*c* each have a vertical row of holes therethrough, these being designated 2*d* and 2*e*, respectively. The holes in one row are transversely aligned with those in the other row, and one row, of course, is at each side of the web. As shown in FIG. 1, holes may be similarly formed in the rear flanges of the uprights.

Figure 2:
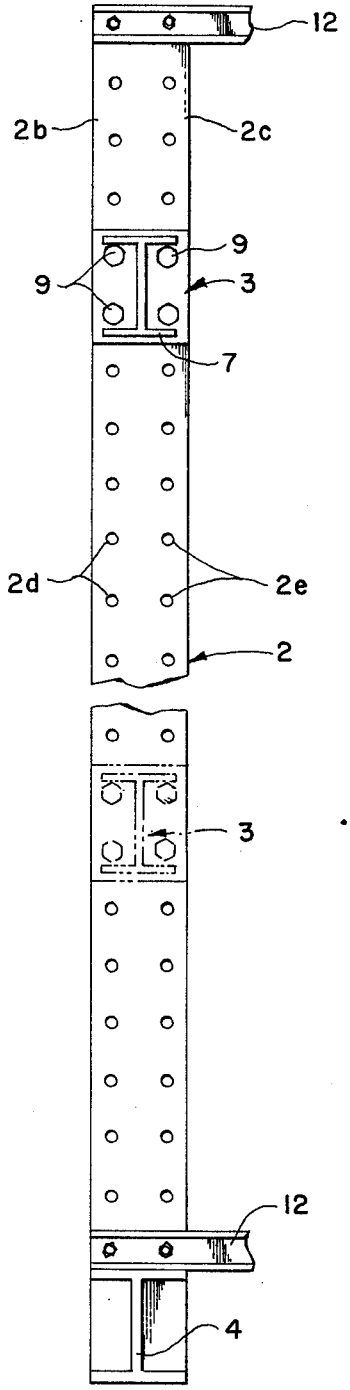
FIG. 2 is a front view of a single column showing only two arms thereon.
Figure 3:
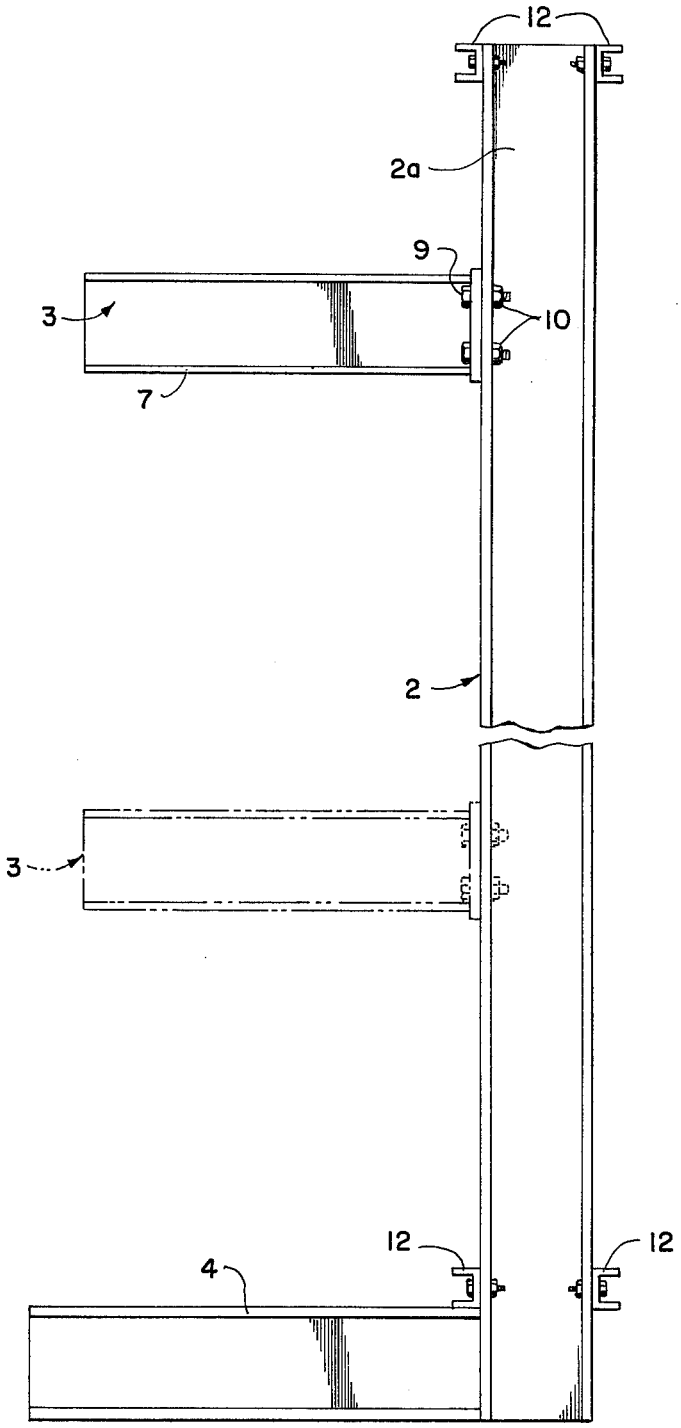
FIG. 3 is a side view of FIG. 2.

As above explained, each column 2 usually has two or more, usually several, vertically-spaced cantilever arms 3 secured thereto, but for clarity and simplicity of illustration only one arm is shown in FIG. 1. More are shown in FIGS. 2 and 3. In many cases the columns may be twenty or more feet in height with arms, prehaps five or more, irregularly spaced from one another at different levels as the storage problems of a particular shop may require.

Each arm assembly 3 comprises an end plate 6 of a width here shown to be equal to the width of the front face of the column 2, but will be adequate even if it is of somewhat less width, and of a height sufficient to exceed the vertical center-to-center spacing of the holes of rows in the rows 2*d* and 2*e*. A length of a structural section 7, such as an I-beam or a channel, has one end welded to the plate 6 so as to project outwardly from the face of this plate and constitute a rigid load-supporting member.

The end has several, at least two and preferably four, holes 8 therethrough, positioned to register vertically and horizontally with an equal number of holes in the rows 2*d* and 2*e*. For example, the plate shown in the drawings has four holes spaced vertically and horizontally the same as any two pairs of transversely-aligned holes in rows 2*d* and 2*e*.

Figure 5:
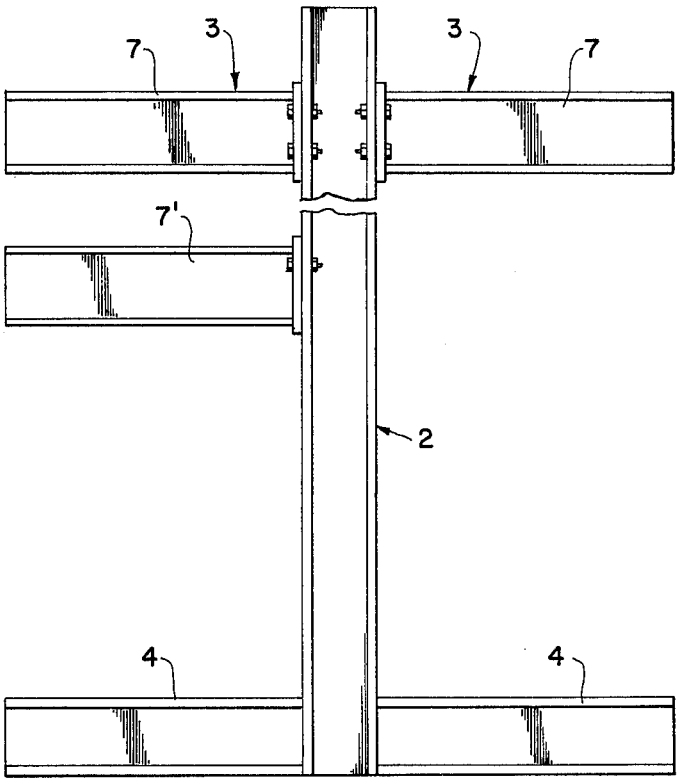
FIG. 5 is a side elevation similar to FIG. 3 of a single column with arms extending in opposite directions.

Bolts 9 are passed through any two registering holes in the end plate, preferably the two upper holes, and through the two registering holes in the flange portions of the columns. Nuts 10 at the inner face of the flange portions are tightened onto the bolts to provide a strong cantilever connection between the arm assembly comprising the end plate 6 and the structural member 7. In lieu of bolts, threaded studs fixed to the plate to project from the rear thereof in the same position as bolts may be used, and the term "bolts" is intended to cover either fastening. The vertical web of the member 7 is centered on the plate 6 so that it substantially, if not exactly, is in the same vertical plane as the web 2*a* of the central column. Any load on the arm 7 exerts a force or moment of stress tending to swing the arm downwardly in an arc and this force is transmitted into the column directly over the web 2*a* where the column can resist stress of this kind most effectively. The wide flanges provide an ample flat surface against which the plate portions 6 of each assembly bear, and the vertical length of each plate is longer than the height of the section 7 that projects outwardly from 4. The distance between the front and back flanges is adequate for full access to the nuts 10 with a wrench for applying or removing them, and the vertical rows of holes are also spaced far enough from the I-beam webs that the nuts and bolts can be removed or tightened, but desirably somewhat closer to the central web of the columns than to the free edges of the flanges.

Where the rack is a free-standing rack as contrasted to one placed against a wall or partition, rows of holes may be formed in both the corresponding front and back flange portions of the column so that arms may be applied to both faces of the column and extend in both directions as clearly shown in FIG. 5. In this case there are base sections 4 extending in opposite directions from the base of the column.

Figure 6:
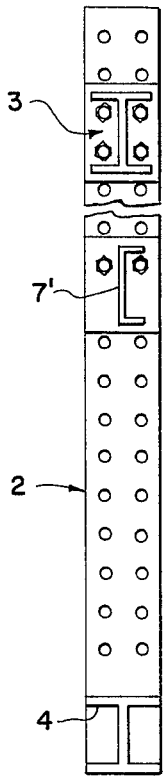
FIG. 6 is a view similar to FIG. 2 but showing two arms formed with different structural sections.

In FIG. 6 I have shown two arms assemblies, one as previously described, and the other having a wide channel section 7' set edgewise and secured to the plate 6 by welding. These arms may be used where a less heavy arm than the I-beam section is needed.

As shown in FIG. 1, conventional parallel channel sections 12 are secured to the front and rear flanges of the I-beam standards, so that they provide in effect a rectangular box brace at the top and bottom. Horizontal braces 13 are also provided with one end 13*a* bolted to one front flange of one column and the other end 13*b* bolted to the back flange of the other column, this crossing from front-to-back being reversed with the braces 13. Also diagonal brace members 15 and 16 are provided. Like braces 13, they are desirably angle bars or channels with the flanges cut away at the ends so that the vertical leg will fit flat against the inner faces of the I-beam flanges to which they are bolted.

The upper end of diagonal brace 15 is bolted at 17 to the front flange of column 2 at the left of FIG. 1 and its lower end at 18 to the rear flange of the column 2 at the right. Diagonal brace 16 has its lower end bolted to the front flange of column 2 at the left and its upper end bolted to the rear flange of the column 2 at the right.

From this it will be seen that in addition to the parallel cross members 12 there are cross members that cross from front-to-back and diagonal cross members that cross from front-to-back to provide a three-dimensional system of bracing that will give maximum rigidity to the rack without material increase of weight.

While I have shown only one system of horizontal front-to-back cross bracing and one system of diagonal braces, these may be duplicated as the height of the rack structure and need for additional bracing is indicated.

Figure 4:
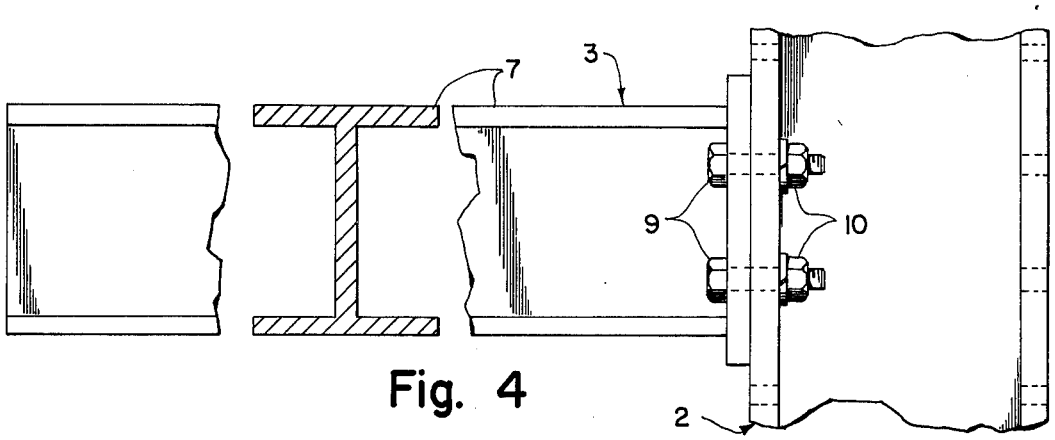
FIG. 4 is an enlarged fragmentary view of a single arm attached to a fragment of a column, but with the column having a row of holes in each flange for arms extending in opposite directions.
Figure 7:
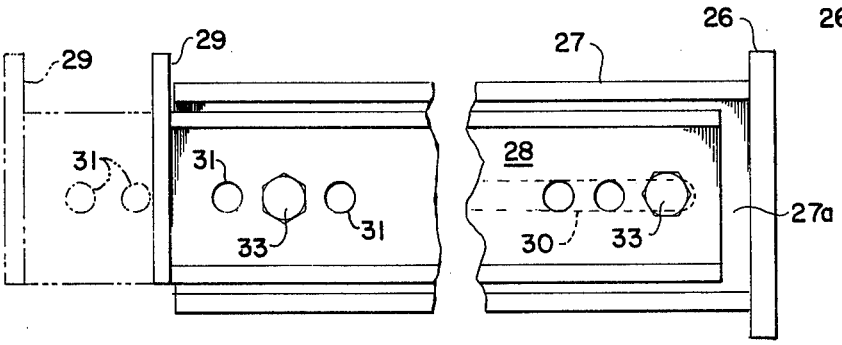
FIG. 7 is a side elevation of an extensible arm apart from the supporting column.
Figure 8:
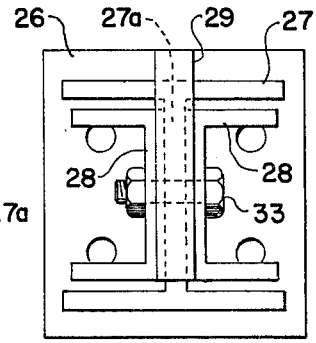
FIG. 8 is a front end view of FIG. 7.

The same holes used to secure the load-supporting arms to the standards may desirably be used to secure the braces in place, and if the end of a brace should coincide with a level where a supporting arm is desired, a longer bolt than is otherwise used can be employed to enable it to pass through the plate of the supporting arm on the I-beam flange but also through the end of the brace which terminates at the same hole.

Where it is desired to have extensible arms, the arrangement shown in FIGS. 7 and 8 may be used. In these views, there is shown an end plate 26, similar to end plate 6 previously described, to which is welded one end of a rigid structural section, preferably an I-beam section 27, similar to section 7 in FIG. 4. At each side of the web 27*a* of section 27 there is a channel section 28 having outwardly-turned flanges. At their outer or front ends these bars are welded to a spacer 29 that projects above the plane of the top of the arm 27, thereby providing a convenient handle by which these two bars may be moved in and out along the bar 27. Near its inner end the web 27*a* of the arm 27 has a longitudinal slot 30 therein. One of two bolts 33 with a nut at one end passes through holes in the bars 28 and through this slot to limit the relative sliding movement of the assembly of the bars 28 and spacer 29 relative to arm 27. The web 27*a* also has at least one hole (not shown) therethrough between the end of the slot 30 and its outer end and one or more holes 31 in the channel sections 28 may be brought into register with said hole in the arm 27 to enable the other bolt 33 to be passed transversely through the channel sections 28 and the web 27*a* and to be then held in place by a nut, thereby locking the sliding assembly in a selected position on the arm 27.

With this invention the webs of the I-beams forming the columns are in planes parallel with the arms and hence are stressed in the direction of their maximum strength, when the rack is heavily loaded. The wide flanges provide safety against the columns twisting under such loads, and columns of considerable height may be safely used. The rows of holes through the flanges provide all of the flexibility of adjustment required in a rack of this kind. The row of bolt holes at each side of the web of the I-beam are far enough from the web of the I-beam to permit ready application of the nuts to the bolts, but not so near the edges of the flanges as to lose the advantage of transmitting the loads on the arm close to the webs of the uprights. The entire structure provides a strong load-supporting cantilever rack structure of simple construction and providing with few parts the flexibility of adjustment to meet the requirements of different shops and different loads. In most cases, the sections 4 at the base of each column will have holes through the bottom flanges thereof, such as the holes indicated at 4*a* in FIG. 1 by means of which the uprights can be fastened to a floor by means such as bolts or lag screws, not shown.

I Claim:

1. A cantilever rack structure comprising:

a. at least two vertical uprights of wide flange I-beam section each with a solid central web and with forwardly and rearwardly facing solid flanges, the webs of the I-beams being in spaced parallel planes and the forwardly facing flanges being in a common plane and with the rearwardly facing flanges being in a common plane, the forwardly facing flanges of each upright having a vertical row of evenly spaced holes therethrough at each side of but spaced laterally from the web and extending throughout the greater portion of the length of the upright from top to bottom, the holes in the flanges of one upright being at about the same level above the bottom of the upright as the corresponding holes in the forwardly facing flange of the other upright;

b. a structural section at the lower end of each upright extending forwardly from the front flange and comprising a rigid horizontal supporting foot member for stabilizing the standard against tilting forward;

c. cantilever arm members adjustably secured to each upright at vertically spaced levels, each arm member comprising a plate and a load-supporting arm rigidly attached to and extending forwardly from the plate member, each plate member having a flat surface bearing against the forwardly facing flange of the upright and of a width adequate to more than span the two rows of holes in the I-beam flange, and of a length from top to bottom at least as great as the vertical dimension of the load supporting arm;

d. each plate having at least two horizontally spaced bolts projecting from the upper portion of the rear face of the plate, each bolt registering with a selected one of the holes in the said vertical row of holes at each side of the web of the upright against which it bears, there being a nut at the rear face of said flange screwed on each bolt whereby the base plate of each cantilever arm member is tightly but removably clamped against the flange to which it is secured by the bolts and nuts;

e. the two rows of holes in each upright being spaced from the webs of the I-beams a distance sufficient to provide clearance for wrenches used in tightening or loosening the nuts and bolts with the distance between the forwardly and rearwardly facing flanges providing clearance for the application and removal of nuts to of from the bolts, but inwardly from the edges of the flanges;

f. means connecting the uprights of the rack structure, the several arm members on the uprights of the rack structure being at corresponding levels; and g. each said load supporting arm comprising a fixed structural section with top and bottom flanges and a vertical web, the vertical web of the structural section of each arm being in the plane of the web of the upright on which the arm is mounted and wherein there is an adjustable extension on the load supporting arm comprising two parallel sections straddling the vertical web of the fixed structural arm and slidable therealong, and bolts passing through selected registering openings in the said two parallel sections and the web of the fixed section which they straddle for holding the adjustable extension in a selected position on the fixed section.

2. A cantilever rack structure comprising:

a. at least two vertical uprights of wide flange I-beam section each with a solid central web and with forwardly and rearwardly facing solid flanges, the webs of the I-beams being in spaced parallel planes and the forwardly facing flanges being in a common plane and with the rearwardly facing flanges being in a common plane, the forwardly facing flanges of each upright having a vertical row of evenly spaced holes therethrough at each side of but spaced laterally from the web and extending throughout the greater portion of the length of the upright from top to bottom, the holes in the flanges of one upright being at about the same level above the bottom of the upright as the corresponding holes in the forwardly facing flange of the other upright;

b. a structural section at the lower end of each upright extending forwardly from the front flange and comprising a rigid horizontal supporting foot member for stabilizing the standard against tilting forward;

c. cantilever arm members adjustably secured to each upright at vertically spaced levels, each arm member comprising a plate and a load-supporting arm rigidly attached to and extending forwardly from the plate member, each plate member having a flat surface bearing against the forwardly facing flange of the upright and of a width adequate to more than span the two rows of holes in the I-beam flange, and of a length from top to bottom at least as great as the vertical dimension of the load supporting arm;

d. each plate having at least to horizontally spaced bolts projecting from upper portion of the rear face of the plate, each bolt registering with a selected one of the holes in the said vertical row of holes at each side of the web of the upright against which it bears, there being a nut at the rear face of said flange screwed on each bolt whereby the base plate of each cantilever arm member is tightly but removably clamped against the flange to which it is secured by the bolts and nuts;

e. the two rows of holes in each upright being spaced from the webs of the I-beams a distance sufficient to provide clearance for wrenches used in tightening or loosening the nuts and bolts with the distance between the forwardly and rearwardly facing flanges providing clearance for the application and removal of nuts to or from the bolts, but inwardly from the edges of the flanges;

f. means connecting the uprights of the rack structure, the several arm members on the uprights of the rack structure being at corresponding levels; and g. the means connecting the vertical uprights of the rack structure comprising horizontally and diagonally extending brace members arranged in pairs, the brace members of at least one pair of diagonal cross brace members each extending from an upper portion of one upright to a lower portion of the other with one of the braces being joined at its upper end to the front flange of one upright and its lower end being secured to the rear flange of the other upright, the other brace of the pair having its upper end to the rear flange of one upright and its lower end to the front flange of the other upright whereby the diagonal brace members cross from front to rear as well as from top to bottom to provide increased strength against any tendency of the uprights to rotate about their vertical axes under load conditions or impacts tending to turn one upright relative to another.

3. The rack structure defined in claim 2 in which at least one pair of horizontal cross members cross each other from front to back with one horizontal cross brace member connected to the front flange of one upright and its other end connected to the rear flange of the other upright, the second brace of the pair of horizontal brace members being reversed from the first.

* * * * *